United States Patent [19]

Dear et al.

[11] 3,983,449

[45] Sept. 28, 1976

[54] DISCHARGE LAMP BALLAST CIRCUITS

[75] Inventors: Peter Adrian Dear; Wladyslaw Pelc, both of London, England

[73] Assignee: Thorn Electrical Industries Limited, London, England

[22] Filed: Nov. 24, 1975

[21] Appl. No.: 634,549

[30] Foreign Application Priority Data

Dec. 11, 1974 United Kingdom ..... 53588/74

[52] U.S. Cl. ..... 315/244; 315/105; 315/DIG. 5

[51] Int. Cl.[2] ..... H05B 41/16

[58] Field of Search ..... 315/105, 244, 247, 283, 315/DIG. 5

[56] References Cited

UNITED STATES PATENTS

| | | | |
|---|---|---|---|
| 2,056,629 | 10/1936 | Uyterhoeven et al. | 315/DIG. 5 |
| 2,170,447 | 8/1939 | Edwards | 315/244 X |
| 2,256,224 | 9/1941 | Thayer | 315/DIG. 5 |
| 2,351,499 | 6/1944 | Freeman | 315/244 X |
| 2,482,894 | 9/1949 | Bird | 315/235 |
| 2,695,375 | 11/1954 | Mendenhall et al. | 315/244 |
| 3,781,597 | 12/1973 | Nomura et al. | 315/105 |

*Primary Examiner*—Eugene La Roche
*Attorney, Agent, or Firm*—Robert F. O'Connell

[57] ABSTRACT

A ballast circuit for a discharge lamp uses simply a capacitor in series with a relatively small inductor the capacitative reactance being between 24 and 55 times the inductive reactance. At these values the third harmonic distortion is unexpectedly low, while the crest factor (ratio of peak to r.m.s. current) is still within acceptance values. Because the inductor is small the efficiency of the circuit is high, and its cost and weight reduced. The capacitance/inductance ratio can be equated to the ratio of the frequency of the tuned circuit to the supply frequency, and on this basis the preferred range is defined by 5 to 7½ times supply frequency.

14 Claims, 4 Drawing Figures

Figure 1:
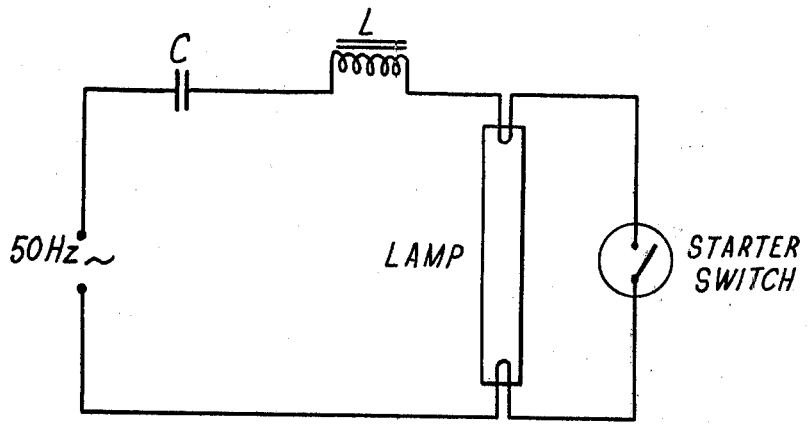

THIRD HARMONIC
CREST FACTOR
UNSTABLE
a
b
c
d
e
f
g
4·0
3·0
2·0
1·0
40
30
20
10
THIRD HARMONIC %
CREST FACTOR
20
30
40
50
60
70
80
REACTANCE RATIO $X_C/X_L$

DISCHARGE LAMP BALLAST CIRCUITS

This invention relates to discharge lamp ballast circuits.

It has long been known that discharge lamps require a current limiting device, or ballast, in series with them for stable operation. Capacitors by themselves when used with discharge lamps as a current limiting device on 50 Hz or 60 Hz power supplies produce a very "peaky" current waveshape, that is the ratio of peak to R.M.S. current through the lamp, the crest factor, is very high, resulting in considerable flicker in the light output and leading to a short life expectation from the lamp electrodes. It has long been known, see for example "Power Plant Engineering", January 1946, pages 66–67, that if an inductor is connected in series with the lamp in addition to the capacitor, acceptable lamp current waveshapes can be obtained. Such circuits operate at a leading power factor. It has previously been considered necessary to use a capacitive reactance ($X_C$) to inductive reactance ($X_L$) ratio of between 2 and 5. Use of such a ratio results in use of an inductor or choke coil having large inductance and hence large size and cost. A large inductor may also have appreciable power loss. It has in the past been assumed that reducing the value of inductance will give the ballast the undesirable characteristics of a capacitor ballast.

We have found, however, that there is another range of reactance ratios which can be used with advantage, that is where the ratio of capacitive reactance to inductive reactance is from about 24 to about 55 at the power supply frequency.

The invention therefore provides in one aspect a discharge lamp ballast circuit comprising two input terminals for connection to an a.c. supply, and two output terminals for connection to a lamp, the ballast consisting of a capacitor and an inductor connected in series between the input and output terminals, the ratio of capacitative reactance provided by the capacitor to inductive reactance provided by the inductor being from 24 to 55 at the supply frequency.

According to the invention there is also provided a discharge lamp ballast circuit comprising two input terminals for connection to an a.c. supply, and two output terminals for connection to a lamp, the ballast consisting of a capacitor and an inductor connected in series between the input and output terminals, and providing a tuned circuit, the ratio of the frequency of the tuned circuit to the supply frequency lying in the range 5 to 7½.

The invention provides in a further aspect a discharge lamp ballast circuit comprising two input terminals for connection to an a.c. supply, and two output terminals for connection to a lamp, the ballast consisting of a capacitor and an inductor connected in series between the input and output terminals, and providing a tuned circuit tuned to a frequency in the range 300 Hz to 450 Hz.

Figure 3:
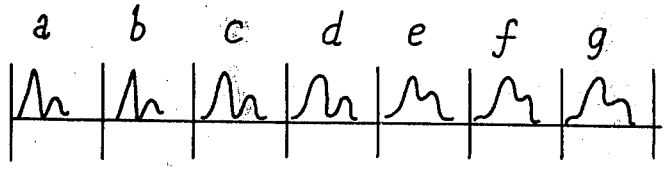
Figure 4:
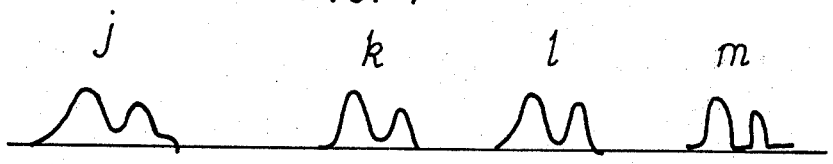
Figure 2:
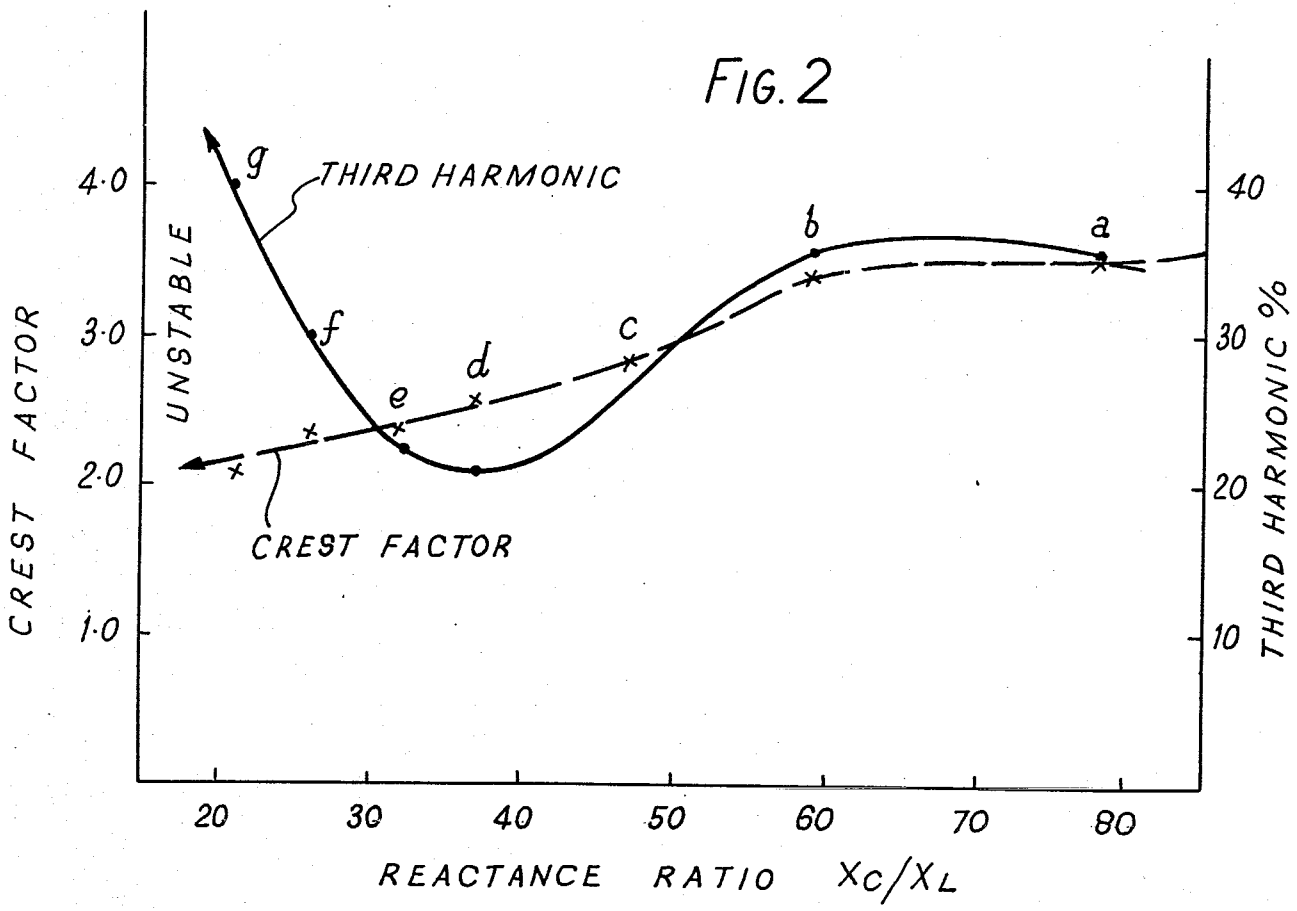

The invention will be described in more detail, by way of example, and with reference to the accompanying drawings, in which:

FIG. 1 is a circuit diagram of a discharge lamp with a ballast circuit embodying the invention;

FIG. 2 plots the crest factor and third harmonic percentage for a range of reactance ratios given in TABLE 1;

FIG. 3 illustrates the current waveform for the same range of reactance ratios; and FIG. 4 illustrates the current waveform for a further series of tests given in TABLE 2.

FIG. 1 shows a simple type of ballast circuit for use with an a.c. supply and which consists of a capacitor C and inductor or choke L in series with a fluorescent discharge tube. A starter switch is connected across the lamp such that when closed during starting of the lamp a heating current flows through both the cathodes of the tube. The starter switch may be of the well-known glow type. Alternatively a separate cathode heating transformer can be used.

In accordance with this invention the inductance of choke L is very much smaller than normal, such that the ratio of the capacitive reactance $X_C$ of capacitor C to the inductive reactance $X_L$ of inductor L is from about 24 to about 55. Because the inductor or choke has a small value of inductance, its power loss can be reduced. The efficiency of the circuit is therefore high, and is higher than for conventional ballasts. Table I below illustrates a series of tests *a* to i performed on an 18 inch long 1 inch diameter fluorescent tube with a 240 volt 50 Hz supply, in which the values of $X_C$ and $X_L$ were varied over a ratio range while keeping the lamp current constant.

TABLE I

| Test | a | b | c | d | e | f | g | h | i |
|---|---|---|---|---|---|---|---|---|---|
| Supply volts | 240 | 240 | 240 | 240 | 240 | 240 | 240 | 240 | 240 |
| Capacitance ($\mu$F) | 4.04 | 4.14 | 4.2 | 4.5 | 4.5 | 4.55 | 4.72 | | |
| $X_C$ at 50 Hz (Ohms) | 786 | 768 | 757 | 708 | 707 | 700 | 673 | | |
| Inductance (Henries) | 0.032 | 0.041 | 0.051 | 0.061 | 0.070 | 0.086 | 0.102 | | |
| $X_L$ at 50 Hz (Ohms) | 10 | 13 | 16 | 19 | 22 | 27 | 32 | 40 | 46 |
| Reactance ratio $X_C/X_L$ | 78 | 59 | 47 | 37 | 32 | 26 | 21 | | |
| Input power (watts) | 13¾ | 14¼ | 14½ | 16½ | 17 | 17¾ | 18¾ | Unstable | |
| Input power factor | 0.13 | 0.14 | 0.14 | 0.16 | 0.165 | 0.17 | 0.18 | current | |
| RMS Lamp current (Amp) | 0.43 | 0.43 | 0.43 | 0.43 | 0.43 | 0.43 | 0.43 | waveform | |
| Peak lamp current (Amp) | 1.5 | 1.45 | 1.2 | 1.1 | 1.0 | 1.0 | 0.9 | -tendency | |
| Lamp voltage | 55.5 | 53.5 | 49.0 | 46.5 | 48.2 | 48.5 | 52.0 | to | |
| Lamp power (watts) | 12½ | 13 | 13¼ | 14½ | 15½ | 16 | 17 | produce | |
| Crest factor | 3.5 | 3.4 | 2.8 | 2.56 | 2.33 | 2.33 | 2.09 | third | |
| Third harmonic % | 35.5 | 35.5 | 26.6 | 21.1 | 22.4 | 29.9 | 40 | harmonic | |
| 5th harmonic % | 59.6 | 63.1 | 66.8 | 63.1 | 56.2 | 56.2 | 42.2 | only | |
| 7th harmonic % | 56.2 | 53.1 | 42.2 | 25 | 17.8 | 6.0 | 5.6 | | |
| 9th harmonic % | 44.7 | 35.5 | 23.7 | 14.1 | 11.9 | 8.9 | 3.2 | | |
| Theoretical tuned circuit frequency (Hz) | 444 | 385 | 344 | 305 | 284 | 254 | 230 | | |
| Harmonic factor | 8.9 | 7.7 | 6.9 | 6.1 | 5.7 | 5.1 | 4.6 | | |

The crest factor is defined as the ratio of the peak to the r.m.s. lamp current, and is seen to vary over a range of from 2.09 to 3.5. The 3rd, 5th, 7th and 9th harmonics in the lamp current were measured as a percentage of the fundamental. The percentage of third harmonic is particularly critical when the lamp is to be supplied from one phase of a three-phase supply. The theoretical tuned circuit frequency is that given by $\frac{1}{2}\pi(LC)^{1/2}$, and the harmonic ratio is defined as this frequency divided by the supply frequency, 50 Hz.

The crest factor and third harmonic percentage are plotted on FIG. 2 against the reactance ratios. The crest factor is high but acceptable over most of the range, although it may be necessary to provide slightly more robust cathodes than are conventionally used.

Interestingly, however, FIG. 2 shows a pronounced dip in the third harmonic percentage centered on a reactance ratio of about 37. Recommendation I.E.C.82 (3rd edition) for Ballasts for Tubular Fluorescent Lamps states that the third harmonic percentage must be below 33 and is preferably below 25. It is seen from FIG. 2 that the percentages 25, 30 and 33 give the following allowable limits for the reactance ratio:

33%; 24 to 55

30%; 26 to 50

25%; 29 to 45

Thus the reactance ratio $X_C/X_L$ should lie on a broad range of from 24 to 55 at the power supply frequency, although it will preferably be in one of the narrower ranges. When taken with the figures for the crest factor, the preferred range is from 29 to about 40.

The ranges can also be defined in terms of the above-mentioned harmonic ratio, namely the ratio of the frequency of the tuned circuit to the supply frequency, and on this basis a broad range of about 5 to about 7½ is contemplated, with a range of about 5½ to about 6¼ being preferred. For a supply frequency of 50 Hz, this gives a broad range of 250 Hz to 375 Hz and a preferred range of 275 Hz to 312½ Hz, and for a supply frequency of 60 Hz, a broad range of 300 Hz to 450 Hz and a preferred range of 330 Hz to 375 Hz. In fact, the ballast passes very little signal at the fundamental supply frequency.

FIG. 3 shows the current waveshape for tests *a* to *g*. Tests *h* and *i* with reactance ratios below 20 produced unstable current waveforms. Tests *a* to *g* however show that in general the current waveshapes are acceptable and in particular the double-hump waveforms of *c* to *f* are perfectly tolerable, and lead to a relatively good crest factor.

Table II below shows the results of further tests with different lamp parameters. Of these tests, test *k* is essentially a repeat of test *e*. Reactance ratios of 31 to 32 were used, these being in the middle of the preferred range indicated by FIG. 2.

TABLE II

| Test | j | k | l | m |
|---|---|---|---|---|
| Tube length (nom., ins.) | 24 | 18 | 18 | 12 |
| Tube diameter (nom., ins.) | 1½ | 1 | 1½ | ⅝ |
| Supply volts | 240 | 240 | 240 | 240 |
| Capacitance ($\mu$F) | 4.5 | 4.5 | 4.5 | 1.94 |
| $X_C$ at 50 Hz (Ohms) | 707 | 707 | 707 | 1640 |
| Inductance (Henries) | 0.070 | 0.070 | 0.070 | 0.17 |
| $X_L$ at 50 Hz (Ohms) | 22 | 22 | 22 | 53 |
| Reactance ratio $X_C/X_L$ | 32 | 32 | 32 | 31 |
| Input power (watts) | 20¼ | 17.5 | 17 | 7¼ |
| Input power factor | 0.21 | 0.17 | 0.18 | 0.145 |
| RMS lamp current (Amps) | 0.40 | 0.43 | 0.40 | 0.21 |
| Peak lamp current (Amps) | 0.9 | 1.0 | 0.85 | 0.49 |

TABLE II-continued

| Test | j | k | l | m |
|---|---|---|---|---|
| Lamp voltage | 57 | 49 | 47 | 50 |
| Lamp power (watts) | 19 | 16 | 15¾ | 6¼ |
| Crest factor | 2.25 | 2.32 | 2.12 | 2.34 |
| Third harmonic | 32 | 25 | 20 | 25 |
| 5th harmonic | 47 | 60 | 50 | 80 |
| Theoretical tuned circuit frequency (Hz) | 280 | 280 | 280 | 280 |
| Harmonic ratio | 5.6 | 5.6 | 5.6 | 5.6 |

It will be seen that all these examples show acceptable crest factors and reasonable third harmonic percentages, though it appears that the best results are obtained with lamps which are less than 24 inches long. The current waveshapes are shown in FIG. 4.

In use, power factor correction can, if required, be made be suitable known methods, but for many applications it is normally not necessary to correct the leading power factor. The starting circuits can be entirely conventional.

Although we have described suitable circuits for operating fluorescent lamps up to 24 inches in length on a supply voltage of 240 V 50 Hz it is possible to operate other discharge and fluorescent lamps with $X_C/X_L$ ratio between about 24 and about 55 if the supply voltage and frequency have different values. In particular, for longer lamps dissipating more power it is desirable to increase the input voltage to the circuit above 240 volts. We believe this arises because longer lamps have an increased power consumption and thus an increased resistance. To maintain a high Q factor for the circuit it is necessary to increase the inductance and reduce the capacitance, thus increasing both the inductive and capacitive impedances. To maintain a desired current through the lamp it is then necessary to increase the supply voltage. The $X_C/X_L$ ratio in all cases relates to the capacitive reactance (ohms) to inductive reactance (ohms) ratio measured at the power supply frequency.

The ballast circuits described provide an acceptable lamp current waveshape without large peaks and which contains a high proportion of odd harmonics, and require only a very small choke coil compared with conventional circuits.

We claim:

1. In a discharge lamp circuit comprising an a.c. supply, and a discharge lamp, a ballast consisting of a capacitor and an inductor connected in series between the supply and the lamp, the ratio of capacitative reactance provided by the capacitor to inductive reactance provided by the inductor being from about 24 to about 55 at the supply frequency.

2. A circuit according to claim 1, wherein the said ratio has a lower limit of about 26.

3. A circuit according to claim 1, wherein the said ratio has a lower limit of about 29.

4. A circuit according to claim 1, wherein the said ratio has an upper limit of about 50.

5. A circuit according to claim 1, wherein the said ratio has an upper limit of about 45.

6. A circuit according to claim 1, wherein the said ratio has an upper limit of about 40.

7. A circuit according to claim 1, wherein the said ratio is from about 29 to about 40.

8. A circuit according to claim 1, wherein the said ratio is about 37.

9. In a discharge lamp circuit comprising an a.c. supply, and a discharge lamp, a ballast consisting of a capacitor and an inductor connected in series between the supply and the lamp, and providing a tuned circuit, the ratio of the frequency of the tuned circuit to the supply frequency lying in the range of about 5 to about 7½.

10. A circuit according to claim 8, wherein the said ratio has a lower limit of about 5½.

11. A circuit according to claim 8, wherein the said ratio has an upper limit of about 6¼.

12. In a discharge lamp circuit comprising an a.c. supply, and a discharge lamp, a ballast consisting of a capacitor and an inductor connected in series between the supply and the lamp, and providing a tuned circuit tuned to a frequency in the range of about 300 Hz to about 450 Hz.

13. A circuit according to claim 11, wherein the said range has a lower limit of about 330 Hz.

14. A circuit according to claim 11, wherein the said range has an upper limit of about 375 Hz.

* * * * *